United States Patent [19]

Holt et al.

[11] 4,242,966

[45] Jan. 6, 1981

[54] RAILWAY CAR TRUCK TRANSOM INCLUDING A TUBULAR BEARING ASSEMBLY

[75] Inventors: Jan D. Holt, St. Charles; Robert K. Neff, St. Louis, both of Mo.

[73] Assignee: ACF Industries, Incorporated, New York, N.Y.

[21] Appl. No.: 33,647

[22] Filed: Apr. 26, 1979

[51] Int. Cl.[3] ..... B61F 3/08; B61F 5/06; B61F 5/08; B61F 5/14

[52] U.S. Cl. ..... 105/182 R; 105/197 R; 105/199 CB; 105/202; 105/208

[58] Field of Search ..... 105/182 R, 197 R, 202, 105/208, 138, 196, 93, 199 R

[56] References Cited

U.S. PATENT DOCUMENTS

| | | | |
|---|---|---|---|
| 2,976,819 | 3/1961 | Rossell | 105/182 R |
| 3,817,188 | 6/1974 | Lich | 105/199 R |
| 3,986,460 | 10/1976 | Voigt et al. | 410/69 |
| 4,030,424 | 6/1977 | Garner et al. | 105/182 R |

*Primary Examiner*—Richard A. Bertsch

*Attorney, Agent, or Firm*—Henry W. Cummings

[57] ABSTRACT

In a railway car truck a transom is provided comprising a pair of tubes rigidly connected respectively to a pair of longitudinally extending side frames. The tubes are longitudinally and vertically aligned and are located below a bolster which extends between the side frames above the transom. A bearing rigidly attached to one of the tubes extends within the other of the tubes. The external surface of the bearing is provided with low friction material to allow the side frames to rock in respective vertical planes about a transverse axis as ups and downs in the track are transversed. However, the transom resists the tendency for the side frames to move longitudinally with respect to each other, and thus maintains the truck in tram.

9 Claims, 4 Drawing Figures

RAILWAY CAR TRUCK TRANSOM INCLUDING A TUBULAR BEARING ASSEMBLY

BACKGROUND OF THE INVENTION

In U.S. Pat. No. 4,030,424 assigned to the same assignee as the present application, a railway car truck is disclosed having a pair of transversely spaced side frames joined by a transverse plate rigidly connected to the lower portion of each side frame to maintain the truck in tram. A bolster including a center bearing extends between the side frames and rests upon spring groups located in vertical slots in the side frames. The weight of the car body is taken on the bolster above the spring groups.

However, the tendency for the side frames to rock respectively in vertical planes about a transverse axis is believed to result in high stresses at the side frame—transverse member joint which may cause fatigue cracks to form.

In U.S. Pat. Nos. 2,976,819; 3,313,245 and 3,817,188, a pair of longitudinally spaced transoms extend transversely between the side frames to maintain the truck in tram. Diagonally spaced cylindrical connections are provided between the transverse members and the side frames. In U.S. Pat. Nos. 2,976,819 and 3,817,188, a resilient sleeve is provided between a rigid collar mounted on the side frame and a cylindrical extension of the transverse member.

However, the requirement of two transverse members to maintain the truck in tram makes these trucks expensive. SUMMARY OF THE INVENTION In a railway car truck a transom bearing assembly is provided including a pair of tubes rigidly connected to each side frame. The tubes are longitudinally and vertically aligned. Near the center of the truck, generally below the center plate, a bearing member is rigidly connected to one of the tubes. The bearing extends within a portion of the adjacent tube. Low friction material located on the outer surface of the bearing and/or the internal surface of the surrounding tube allows relative rotation between the bearing and the surrounding tube as the side frames rock in vertical planes about a transverse axis as ups and downs in the track are traversed. Preferably a collar is rigidly connected to one of the transverse members to define the surrounding surface for the bearing. Also preferably the low friction material is a polymeric material having long wear, most preferably nylon-based, and a relatively constant coefficient of friction with the adjacent metallic surface to obtain a satisfactory, long-life bearing assembly. However, the transom resists the tendency for the side frames to move longitudinally with respect to each other, and thus maintains the truck in tram.

DESCRIPTION OF PREFERRED EMBODIMENTS

Figure 1:
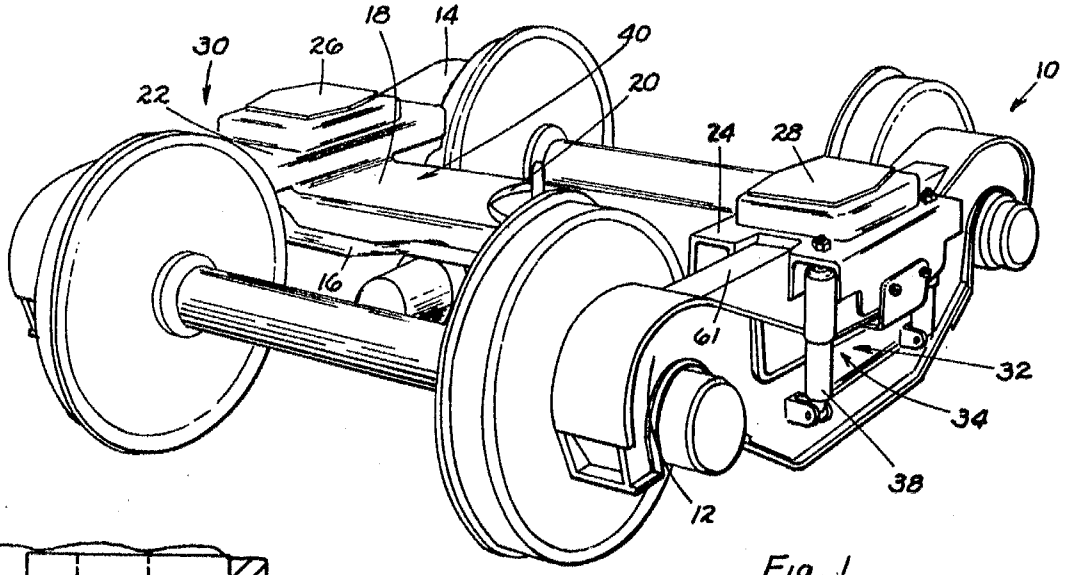
Figure 2:
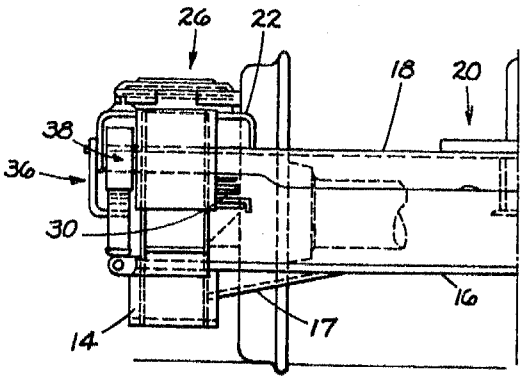
Fig. 2 PRIOR ART

As disclosed in U.S. Pat. No. 4,030,424, assigned to the same assignee as the present application and hereby incorporated into the present application by this reference, a railway car truck 10 includes a pair of spaced side frames 12 and 14. A transverse plate 16 extends between the side frames and is rigidly connected to the lower portion of each side frame. Plate 16 is reinforced at 17 (FIG. 2). A bolster 18 includes a center bearing 20 and a pair of upwardly extending end portions 22 and 24. Upon each bolster end portion is located a car body bearing assembly indicated at 26 and 28. Bolster end portions 22 and 24 rest upon spring groups 30 and 32 which are located within openings 34 and 36 in the respective side frames 12 and 14. The weight of the car body is taken upon the respective car body bearing assemblies 26 and 28 above the spring groups 30 and 32. Dampers 38 attached to bolster end portions 22 and 24 and the respective side frames 12 and 14 aid in controlling truck rock and roll.

In prototype testing of the railway car truck described in U.S. Pat. No. 4,030,424, hunting was essentially eliminated at speeds up to 100 miles per hour, and rock and roll was minimized by the spring groups 30 and 32 and the dampers 38. However, it was found that high stresses tended to occur in the transverse member 16 in the area where the transverse member joins the side frames 12 and 14.

Figure 3:
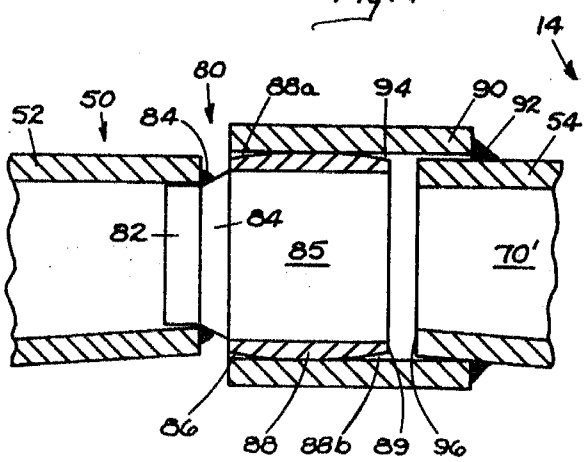
Figure 4:
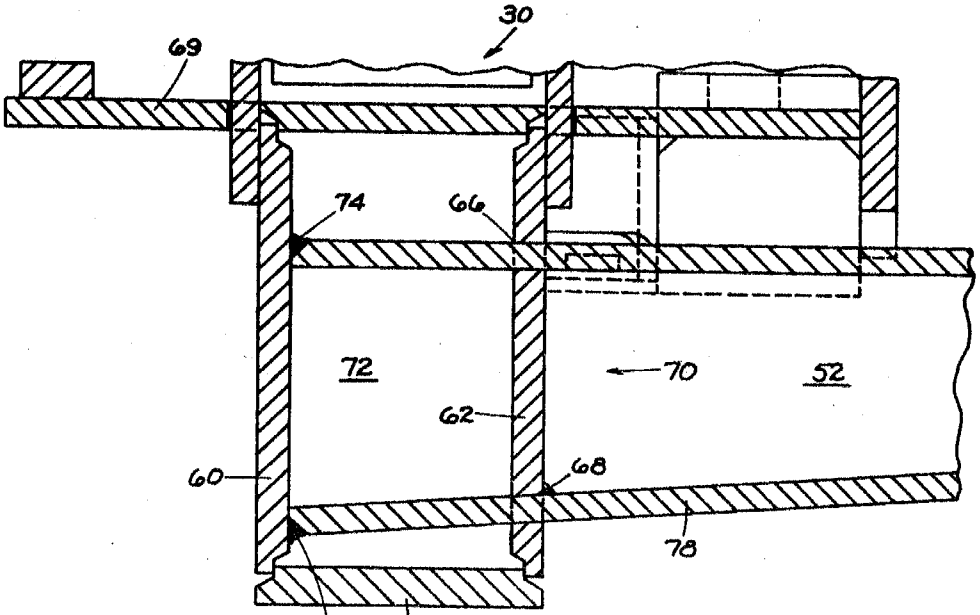

In order to avoid these high stresses, the transom 16 of U.S. Pat. No. 4,030,424 is replaced with the transom indicated in the drawings generally at 50. As shown in FIG. 4, this transom includes a pair of tubes 52 and 54. Each has a circular cross section and is rigidly attached to the respective side frames 12 and 14, as shown in FIG. 4. The tubes are aligned vertically and longitudinally. The connections to the side frames are the same on both sides of the truck so only one is illustrated and described. As is apparent from FIG. 5, each of the side frames includes a pair of vertical webs 60 and 62 joined by a lower closure plate 64. Web 62 includes a circular opening 66. Tube 52 includes an end portion 70 which passes through opening 66 and is welded to web 62 as shown at 68. The inner edge 72 of the tube is welded to vertical web of the side frame 60 as indicated at 74. The bottom 78 of tube 52 is inclined upwardly. Vertical webs 60 and 62 are welded to plate 69 upon which rests spring groups 30 described in U.S. Pat. No. 4,030,424. Tube 54 has a similar end portion 70' (FIG. 3) constructed in the same manner as end portion 70 and welded to side frame 14 in the same manner.

A bearing assembly 80 is attached to the internal surface of tube 52. Bearing 80 includes a circular portion 82 extending within tube 52 and is welded thereto as indicated at 84. The diameter of bearing 80 increases at transition portion 84. A bearing body portion 85 is integral with transition portion 84 and extends within a collar 90 welded to tube 54 at 92. Bearing body portion 85 provides support and structural integrity for a bearing portion 86. Bearing portion 86 is made of low friction material and is bonded to bearing body portion 85. Bearing portion 86 preferably has a coefficient of friction with steel of not more than 0.2. Furthermore, this coefficient of friction is generally stable with time and temperature changes.

Collar 90 extends and surrounds bearing portion 86. Collar 90 is conveniently made of steel. The internal surface 94 of collar 90 engages the external surface 88 of bearing 86. Surface 88 includes tapered portions **88*a* and 88*b*. Relative rotation occurs between bearing 88 and collar surface 94 as side frames 12 and 14** rock in vertical plane about a transverse axis as ups and downs in the track are traversed. The rigid tubes resist longitudinal movement of one side frame with respect to the other.

An example of a suitable low friction material for bearing portion 86 is disclosed and claimed in U.S. Pat. No. 4,001,124, hereby incorporated into the present application by this reference and assigned to a wholly owned subsidiary of the assignee of the present application. This low friction material is a nylon base material containing a high molecular weight halogenated polyethylene filler and polytetrafluorethylene as a bearing component.

However, it is within the scope of the present invention to use other known low friction materials for the bearing surface 86. An example of an alternative composition is found in U.S. Pat. No. 3,013,967 assigned to Dixon Corporation of Rhode Island, including nylon, perfluoropropylene and tetrafluoroethylene.

It will be apparent that allowing tubes 52 and 54 to rotate with respect to one another as ups and downs in the track are traversed greatly reduces the stress that the transom is subjected to as such ups and downs are traversed. It is thus believed that the high stresses which occurred in the transverse member in U.S. Pat. No. 4,030,424 are reduced and/or eliminated by the rotatable transom of the present invention. Furthermore, the new transom described by the present invention is stronger without the addition of stiffners than the construction of U.S. Pat. No. 4,030,424. Furthermore, only a single transverse member is required in contrast to the construction shown and described in U.S. Pat. Nos. 2,976,819; 3,313,245 and 3,817,188.

What is claimed is:

1. A single transom for a railway car truck comprising: a pair of tubes rigidly connected respectively to a pair of longitudinally extending side frames; said tubes being longitudinally and vertically aligned, and located below a bolster which extends between the side frames above the transom; a bearing rigidly attached to one of the tubes; said bearing extending within the other of the tubes; a layer of low friction material located between said bearing and said other tube to allow the side frames to rock in a vertical plane about a transverse axis as vertical undulations in the track are traversed; said transom having sufficient rigidity to resist the tendency for the side frames to move longitudinally with respect to each other, whereby said truck is maintained in tram.

2. A railway car truck according to claim 1 including a collar rigidly connected to one of said tubes to define said surrounding surface for the bearing, and wherein said layer of low friction material is located on said bearing.

3. A transom according to claim 1 wherein said layer of low friction material is located on the external surface of said bearing.

4. A transom according to claim 3 wherein the low friction material is a polymeric material having long wear, and a relatively constant coefficient of friction with the adjacent surface to obtain a satisfactory, long life bearing assembly.

5. A transom according to claim 4 wherein said polymeric material is nylon-based and said adjacent surface is steel.

6. In a railway car truck including a pair of longitudinally extending side frames each having an opening therein; a spring group located in each opening and supported by said side frames; a bolster extending between the side frames and resting on said spring groups; said bolster containing a center bearing and a pair of car body bearing assemblies located above said respective spring groups; the improvement comprising a single transom bearing assembly including a pair of tubes rigidly connected to each side frame; said tubes being longitudinally and vertically aligned; a bearing member rigidly connected to one of the tubes near the center of the truck; said bearing extending within a portion of the adjacent tube; a layer of low friction material located between said bearing and the internal surface of said adjacent tube whereby relative rotation between the bearing and the surrounding tube may occur as said side frames rock in vertical planes about a transverse axis as vertical undulations in the track are traversed; said tube having sufficient rigidity to resist the tendency for the side frames to move longitudinally with respect to each other.

7. A railway car truck according to claim 6 including a collar rigidly connected to one of said tubes to define said adjacent tube, and wherein said layer of low friction material is located on said bearing.

8. A railway car truck according to claim 2 wherein the low friction material is a polymeric material having long wear, and a relatively constant coefficient of friction with the adjacent surface to obtain a satisfactory, long life bearing assembly.

9. A railway car truck according to claim 8 wherein said polymeric material is nylon-based and said adjacent surface is steel.

* * * * *